US006089059A

United States Patent [19]

Fan

[11] Patent Number: 6,089,059

[45] Date of Patent: Jul. 18, 2000

[54] CYLINDER LOCK

[75] Inventor: Fang-Yi Fan, Tai-Pao, Taiwan

[73] Assignee: I Ding Metal Enterprise Co., Ltd., Chiayi Hsien, Taiwan

[21] Appl. No.: 09/190,112

[22] Filed: Nov. 12, 1998

[30] Foreign Application Priority Data

Apr. 29, 1998 [TW] Taiwan ..... 87206735

[51] Int. Cl.[7] ..... E05B 9/04

[52] U.S. Cl. ..... 70/371; 70/375; 70/379 R; 70/493

[58] Field of Search ..... 70/367, 371, 379 R, 70/380, 375, 378; 292/DIG. 39, 350, 355, 492, 493

[56] References Cited

U.S. PATENT DOCUMENTS

| | | | |
|---|---|---|---|
| 1,484,406 | 2/1924 | Ottinger . | |
| 1,597,517 | 8/1926 | Estabrook . | |
| 1,832,108 | 11/1931 | Falk | 70/380 |
| 2,247,621 | 7/1941 | Speer | 70/380 |
| 3,336,794 | 8/1967 | Gray et al. | 70/367 |
| 3,500,670 | 3/1970 | Hawkins | 70/375 |
| 4,211,097 | 7/1980 | Martikainen et al. | 70/379 R |
| 4,631,942 | 12/1986 | Sierra | 70/371 |
| 5,121,618 | 6/1992 | Scott | 70/371 |
| 5,138,856 | 8/1992 | Chyun | 70/375 |
| 5,966,973 | 10/1999 | Watts | 70/375 |

*Primary Examiner*—Darnell Boucher
*Attorney, Agent, or Firm*—Rosenberg, Klein & Lee

[57] ABSTRACT

The present invention relates to a detachable cylinder lock, which includes a case shell having an axial row of conic pin-holes for avoiding the pins falling out; a cylinder having a row of pinholes, in which a lower pin is located, corresponding to the pinholes of the case shell; the cylinder has an axial keyhole for a key inserting in, and a slant face (or a conic face) for the convenience of the cylinder inserting into the cylinder hole of the case shell; a follow block has a hole for the rear lug of the cylinder inserting in, and a cross hole penetrating through them for a fastening component screwing in or out.

5 Claims, 2 Drawing Sheets

CYLINDER LOCK

BACKGROUND OF THE INVENTION

1. Field of the Invention

The present invention relates to a cylinder lock, and more particularly to a detachable cylinder lock.

2. Description of Prior Art

In accordance with a conventional detachable cylinder lock, due to the complicated structure, so it not only causes a tough manufacture with high production cost, but also demands two keys for one set, one for unlocking in common time, the another for release the cylinder. So it brings about inconvenience to the user.

OBJECTS AND SUMMARY OF THE INVENTION

It is therefore a main object of the present invention to provide a detachable cylinder lock that just need only one key for taking two tasks-unlock and release the detachable cylinder.

The object of the present invention is archived by below technique design. The detachable cylinder lock comprises a case shell, a cylinder, a follow block, a key, several pin kits, and a fastening component. Wherein the case shell has an axial through cylinder hole for the cylinder locating in, an axial row of pinholes crossing to the cylinder hole for setting the pins in. The cylinder has a keyhole at the face end, and an axial row of pinholes corresponding to the pinholes built on the case shell. In the each pinhole composed by pinholes of the cylinder and the case shell, a pin kit comprising a lower pin, an upper pin, a spring and a pin-stop, is set. The key has several teeth coordinating to the pins so that as turning the key in the keyhole, the each tooth can push up the corresponding lower pin to make the interface of the lower pin and the upper pin get the adjoining face between the case shell and the cylinder exactly, in order to make the cylinder slide in or out fluently. Meanwhile, for preventing the upper pin from falling out, the upper pins and the pinholes on the case shell are made into taper shape or other unequal diameter shapes. On the rear end, the cylinder has a slant guide face for pushing up all the upper pins into pinholes of the case shell, and lug for connecting with the hole of the follow block. The fastening component can screw the cylinder and the follow block down or off crossly.

There is a cross hole built upon the lug at the rear end of the cylinder and the hole of the follow block respectively, one of them is a screw hole, for a fasten component fitting in. And the screw—a fastening component, fastens them up.

DETAILED DESCRIPTION OF PREFERRED EMBODIMENTS

Figure 1:
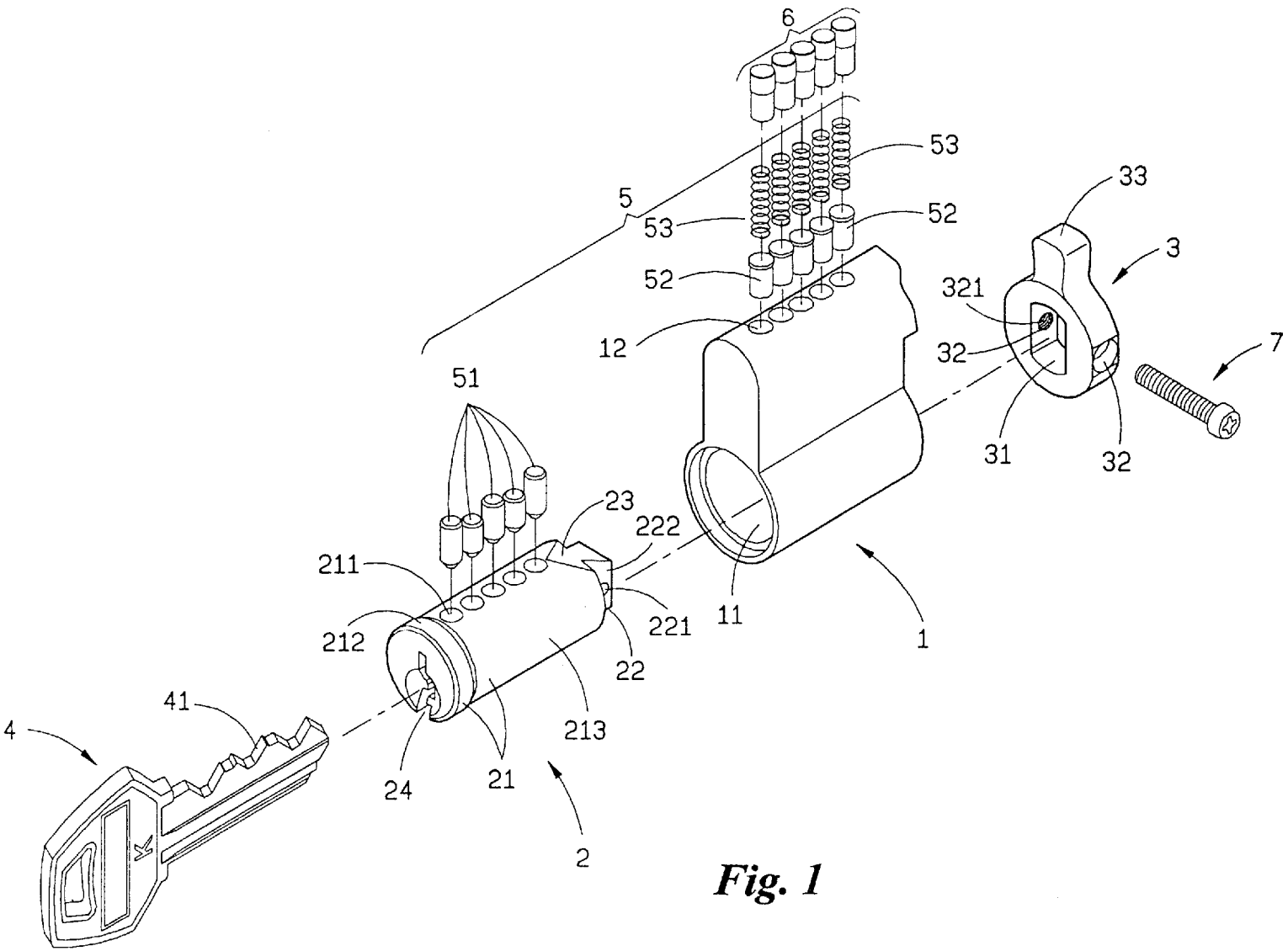
FIG. 1 is an exploded view of the present invention.

Referring to FIG. 1, the detachable cylinder lock provided by the present invention includes a case shell 1, a cylinder 2, a follow block 3, a key 4, several pin kits 5, several pin stops 6 and a fastening component 7. Wherein the case shell 1 has an axial through cylinder hole 11 for the cylinder 2 locating in, and an axial row of pinholes 12 crossing to the cylinder hole 11 for setting the pins in. The cylinder 2 has a keyhole 24 at the face end 21, and an axial row of pinholes

211 corresponding to the pinholes 12 built on the case shell 1. In the every pinhole composed by pinholes 12 211 of the cylinder 2 and the case shell 1, a pin kit 5 is set. Said pin kit 5 comprises a lower pin 51, an upper pin 52, a spring 53, and they are sealed in the pinhole by the pin-stop 6. The follow block 3 has a projection lug 33 for triggering the latch device of the lock (not shown). The key 4 has several teeth 41 co-ordinating to the pin kits 5 so that the each tooth 41 can push up the corresponding lower pin 51 to make the interface of the lower pin 51 and the upper pin 52 get the adjoining face between the cylinder hole 11 of the case shell 1 and the cylinder 2 exactly to allow the cylinder 2 to be swivelled in the cylinder hole 11 by turning the key 4 fluently, thereby lock or release the lock. The fastening component 7 is a screw.

Figure 2:
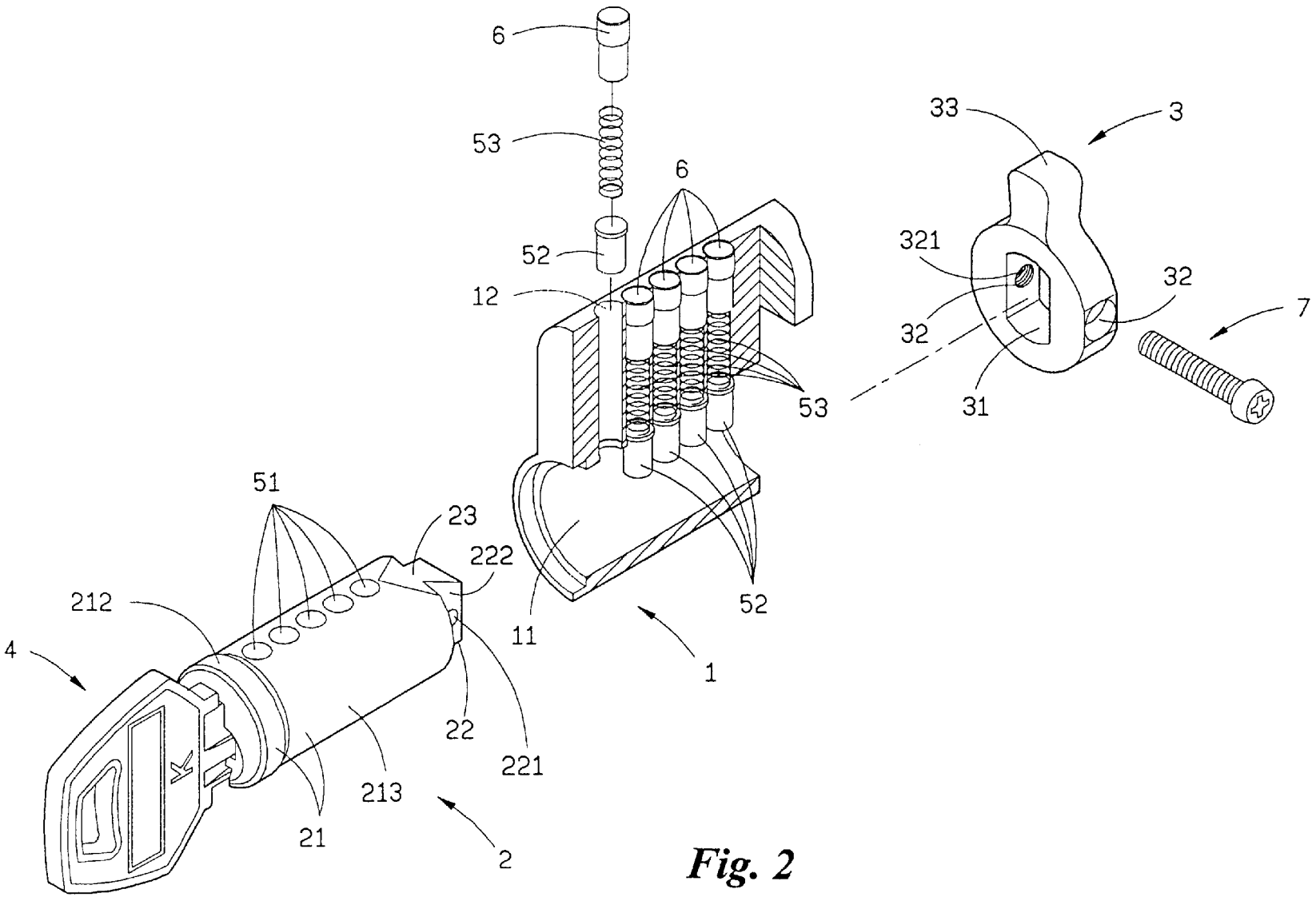
FIG. 2 is an exploded view showing an operation of the present invention.

Referring to FIG. 2, for preventing the upper pin 52 from falling out the pinhole 12, the upper pins 52 and the pinholes 12 on the case shell 1 are made into taper shape or other unequal diameter shapes. On the rear end 22, the cylinder 2 has a slant guide face (or a conic face) 23 for pushing up all the upper pins 52 into pinholes 12 of the case shell 1 for the convenience of fitting the cylinder 2 in the axial cylinder hole 11, and a lug 222 built upon the rear end for connecting with the hole 31 of the follow block 3. The fastening component can screw the lug 222 of the cylinder 2 and the hole 31 of the follow block 3 down or off crossly.

The outside surface of said cylinder 2 includes two cylinder faces with different diameters—like a locating shoulder to prevent the cylinder 2 s from moving about axially, when lug 222 on the rear end of the cylinder 2 is fixed in the hole 31 of the follow block 3 by the screw 7.

As detaching the cylinder 2 from the lock, by screwing out the fastening component 7 with the screwdriver, the cylinder 2 including the inside lower pins 51 can be drawn out with the key from the axial hole 11 of the case shell 1. After rearranging the lower pins 51's position or arranging a new set of the lower pins 51 coordinating a new key 4, the cylinder 2 can be reinstalled into the axial hole 11 of the case shell 1 with the key 4, and inserted into the hole 31 of the follow block 3 so as to make the cross-hole 221 of the cylinder coincide with the cross holes 32 of the follow block 3 rightly. Then fasten them up with the fastening component 7 through the cross-holes 221 and 32. The cylinder lock is rebuilt at all.

I claim:

1. A detachable cylinder lock, comprising:

a case shell including a hollow body having a through opening axially extending within said hollow body, and an upper wall upwardly projecting from said hollow body, a plurality of first pin channels extending through said upper wall, said first pin channels communicating with said through opening defined within said hollow body of said case shell;

a cylinder member removably received within said through opening of said hollow body, said cylinder member having a first end and a second end, said cylinder member having formed therein a plurality of second pin channels and a key receiving slot;

said cylinder member further including:

a slanted guide surface integrally formed at said second end of said cylinder member, and a lug axially projecting from said cylinder member at said second end thereof, a through cross channel being formed within said lug, said cross channel extending transversely relative to a longitudinal axis of said cylinder member;

a plurality of lower pins, each disposed within a respective one of said second pin channels;

a plurality of assembling structures, each said assembling structure including an upper pin, a pin stop and a spring disposed between said upper pin and said pin stop, each said assembling structure being received in a respective one of said first pin channels defined in said case shell;

a follow block, including a base having an outer wall portion defining a central through opening for receiving said lug of said cylinder member therein, said outer wall portion having formed therein cross-holes symmetrically defined in alignment with said cross channel formed through said lug of said cylinder member; and, a fastening component passing through said cross-holes defined in said follow block and said cross channel defined in said lug of said cylinder member;

whereby a key received within said key receiving slot of said cylinder member is adapted to engage said lower pins disposed in said second pin channels.

2. The detachable cylinder lock as claimed in claim 1, wherein said lug at said second end of the cylinder member is a radial strip lug.

3. The detachable cylinder lock as claimed in claim 1, wherein said cross channel in said lug of said cylinder member and said cross-holes defined in said follow block have threaded internal surfaces.

4. The detachable cylinder lock as claimed in claim 1, wherein said follow block has a radial lug projected outwardly from said wall of said follow block.

5. The detachable cylinder lock as claimed in claim 1, wherein said fastening component is a screw.

* * * * *